United States Patent [19]

Wiese

[11] 4,361,991

[45] Dec. 7, 1982

[54] SEATING AND GUARD RAIL STRUCTURE FOR BLEACHERS

[76] Inventor: Harold Wiese, North Highland, Box 236, Madison, S. Dak. 57042

[21] Appl. No.: 132,974

[22] Filed: Mar. 24, 1980

[51] Int. Cl.[3] ..... E04H 3/12

[52] U.S. Cl. ..... 52/9; 52/183

[58] Field of Search ..... 52/9, 10, 67, 183; 182/106; 14/69.5

[56] References Cited

U.S. PATENT DOCUMENTS

| | | | |
|---|---|---|---|
| 3,964,215 | 6/1976 | Hartman et al. | 52/9 |
| 4,006,564 | 2/1977 | Wiese | 52/9 |
| 4,014,522 | 3/1977 | Sutter | 52/9 X |
| 4,030,255 | 6/1977 | Hartman | 52/9 |
| 4,193,229 | 3/1980 | Hartman | 52/9 |

*Primary Examiner*—Carl D. Friedman
*Attorney, Agent, or Firm*—Carl C. Batz

[57] ABSTRACT

A seating and guard rail structure for bleachers having seating sections which may be compacted together to occupy a minimum space during storage and having guard rail units which may be compacted along with the seating sections. Mechanisms are included for turning the guard rail units when the seating sections are compacted to facilitate their storage and for turning the guard rail units back again to their normal upright position when the seating sections are expanded in preparation for use; also locking mechanisms are provided for locking the guard rail units in their upright positions when the seating sections are fully expanded for use, and means are provided for unlocking the guard rail units when the seating sections are compacted.

9 Claims, 8 Drawing Figures

SEATING AND GUARD RAIL STRUCTURE FOR BLEACHERS

This invention relates to a seating and guard rail structure which is particularly useful in connection with compactable bleachers.

BACKGROUND

Bleachers have long been used to seat a multitude of people at sport events and other public performances where a large number of people are gathered. The bleachers may be used indoors as in school gymnasiums or outdoors. Especially where bleachers are used indoors they take up much valuable space and it is known to provide bleachers of the type having movable sections so that when the bleachers are not in use the sections may be moved into each other, enabling the sections to occupy a minimum of space when they are stored, the sections being extendable into position for use when they are again needed.

Guard rails are needed for purposes of safety in the case of the compactable bleacher sections just as they were in the case of permanent seat installations, but special problems arose in making the guard rail structures collapsible along with the seating sections.

One type of solution to such problems is to provide telescoping guard rails which allow the guard rails to decrease in length as the bleacher seats are compacted into each other. This is illustrated in my prior U.S. Pat. Nos. 3,401,918, 3,995,832 and 4,006,564, also in the Hartman U.S. Pat. No. 4,030,255. Other U.S. Pat. Nos. of lesser pertinency are Ryden 2,757,002; Rubenstein 2,225,889; and Schroer 2,834,621.

While the provision of telescoping rails is a substantial improvement in the art, these have some disadvantages in that they require precision in their manufacture and there are limits as to how much the rails can reasonably be expanded and shortened in length.

Accordingly, I have set about to discover ways and means by which a simplified seating and guard rail structure can be provided, preferably utilizing one piece guard rail units, while still permitting the seating sections and the guard rail units to be expanded or compacted. More specifically, it was desired to provide means for moving the guard rail units to upright position and maintaining them in such position while the seating sections are being expanded, and means for moving the guard rail units into compact position for storage while the sections are being compacted. Further, it was desired that such a means be automatically operated as the seating sections are being expanded or compacted.

One embodiment of my invention by which such improvements are accomplished and such desires are met, is illustrated in the accompanying drawings in which FIG. 1 is a broken side elevational view showing seating sections and guard rail units when the seating sections are in expanded position;

The improved seat and guard rail units of this invention may have any number of similar seating sections and corresponding guard rail units, but for ease of description and explanation only seating sections A, B, and C and guard rail units D and E shown on the accompanying drawings will be described and explained in detail, it being understood that other similar seat sections and guard rail units may be constructed and operated in like manner.

Figure 1:
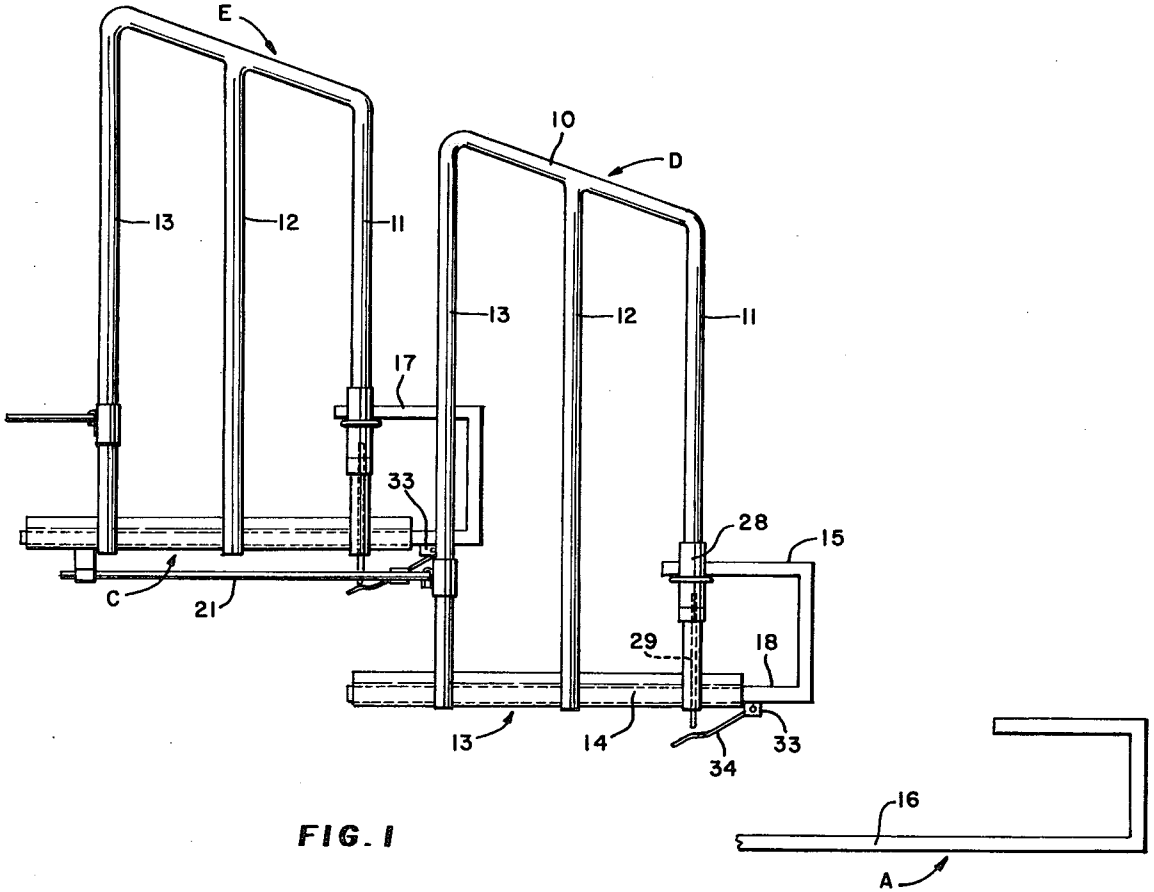

As illustrated in FIG. 1, seating section A is the front and lowest seating section when the sections are in their extended positions. No guard rail unit is attached to seating section A. Seating section B is next above and adjacent to section A, and next above and to the rear of section A is the seating section B. Next above and to the rear of section B is the seating section C. Guard rail units D and E are attached respectively to seating sections B and C.

Figure 2:
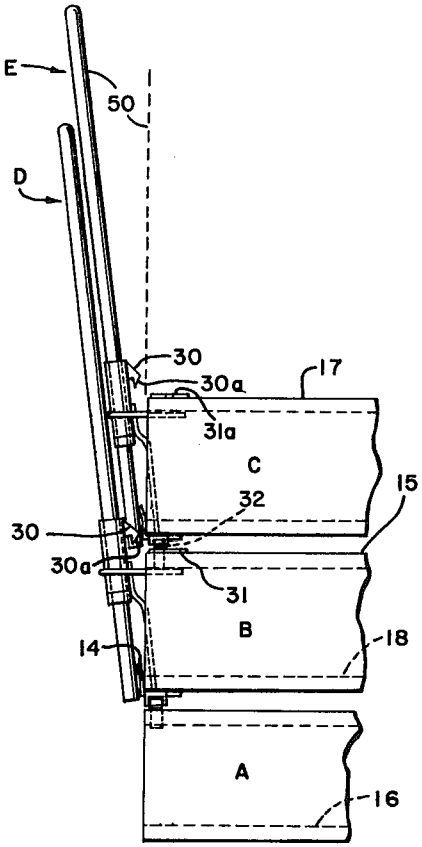
FIG. 2 is a broken front elevational view of the improved structure when the seating sections have been moved into compacted position for storage.

With the seating structure in expanded position as shown in FIG. 1, people may sit on seat 15 of seating section B with their feet on floor 16 of section A, and on seat 17 of section C with their feet on floor 18 of section B. As shown in FIG. 1 the two guard rail units D and E should be erect, vertical and aligned with each other when the seating sections are in their expanded positions. As shown in FIG. 2 the guard rail units, each in its turn, has been moved to inclined position and each of the seating sections has been, in its turn, moved together for storage. If the guard rail units were to be left in their vertical positions they would strike each other when the seating sections are compacted, but by moving these units to an inclined position as shown in FIG. 2 and guard rail units on a lower seating section come to be lower than the guard rail unit next above, and so comes into the nesting relationship illustrated in FIG. 2.

Attention is now called to the structure of the guard rail units. As seen more clearly in FIG. 1, each of these units includes a rail 10 which is inclined downwardly toward the front. Depending from rail 10 are the standards 11, 12, and 13. Rail 10, together with standards 11, 12, and 13, make a one piece unitary structure.

Figure 4:
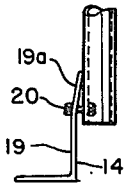
FIG. 4 is a detail sectional view taken along line 4—4 of FIG. 3 showing the connection between the guard rail units and the seating sections when the guard rail units are erect.
Figure 5:
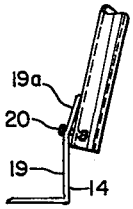
FIG. 5 is a detail view taken along line 5—5 of FIG. 3 when the guard rail units are in inclined position ready for compaction of the seating sections and guard rail units.

Guard rail unit D has its standards 11, 12, and 13 attached at their lower ends to the support member 14 which, in turn, is secured to seating section B. The shape of member 14 and its relationship with the guard rail unit D is more clearly shown in FIGS. 3, 4, and 5. Member 14 may be an angle iron having a vertical flange 19 which, at its top edge portion 19*a* is turned outwardly. The lower ends of standards 11, 12, and 13 are loosely attached to the flange 19 of the member 14 by use of a bolt 20 so that the top edge of the flange bears resiliently against the standards when the guard rail unit is in vertical position (FIG. 4) and permits the guard rail unit to turn to its inclined position (FIG. 5).

The mechanism for turning the guard rail unit to inclined position when seating section B is compacted with seating section C and for turning the guard rail unit from its inclined position to an erect or upright position as the seating section B is separated from seating section C, includes a sliding adjusted rod 21 which is secured to seating section C. At its rear end portion 23 rod 21 is quite straight, but at its front end portion 24 this rod leads inwardly and is secured to the angle iron 22 which is secured to seating section C.

Figure 7:
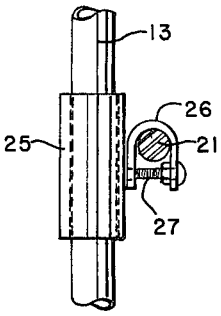
FIG. 7 is a broken detail elevational view of the connection between the guard rail units and the means for moving the guard rail units to storage positions.

The standard 13 of guard rail unit D has a collar 25 thereabout (FIGS. 3 and 7), and secured to this collar is a bracket 26 which extends over and rides along the rod 21. A bolt 27 secures the bracket to the collar 25 and holds the rod within the bracket. The bracket and the collar are free to ride on and along the rod. The collar may move longitudinally of the standard 13 and may also turn angularly with respect to the standard.

When the sections are compacted as shown in FIG. 2, the standards 11, 12, and 13 of guard rail units D and E are in inclined position. The standard 13 of guard rail unit D, when the units are compacted, is shown in dotted lines in FIG. 3. When seating section B is pulled forwardly of seating section C the collar 25 moves from its position shown in dotted lines in FIG. 3 and rides along the straight portion 23 of rod 21. When this collar reaches the front portion 24 of rod 21 where rod 21 turns inwardly, the collar follows the rod and moves the standard 13 on which it is mounted, inwardly about its pivot at its point of attachment of this standard to seating section C, thus moving the guard rail unit to its upright position.

When the seating section B is moved back toward the seating section C, as would be done in compacting the seating sections, the collar 25 is caused to move rearwardly and outwardly causing the guard rail unit to again tilt outwardly to its inclined position shown in FIG. 2, and to remain in this position as compaction of the seating section B is completed.

The angle through which the guard rail units are tilted is sufficient to allow the guard rail unit D to pass under the inclined guard rail unit attached to the next above seating section. When using standards having an outside diameter of about 1 inch I have found it satisfactory that the angle through which the guard rail units be inclined (angle 50 of FIG. 2) be about 17 degrees.

It may be observed that the bar 21, which is secured to seating section C, is an important part of the mechanism for tilting guard rail unit D which is attached to seating section B. Thus, the direction and angle of tilt of the guard rail unit attached to one seating section is controlled principally by mechanism on the next rearward, or the next higher, seating section.

Forward of the point where rod 21 is attached to the seating section C is a couple 21*a* (see FIG. 3) which may be turned to move the current position of rod 21 either forwardly or rearwardly. This provides adjustment of the position of rod 21 for advancing or delaying the turning of the guard rail unit to its slanted position when coupling 21*a* is turned to move rod 21 forwardly (toward seating section B), this operates to advance the time (during the compacting of seating section B and C) when the guard rail unit D is turned from its upright position to its slanted position and also delays the time (during the extension of the seating section B from seating section C) at which the guard rail unit is turned from its slanted position to its upright position.

To prevent the collar 28 from falling down farther then necessary on standard 11 when the locking mechanism is unlocked I provide the ring 28*a* which has screw 28*b* by which it may be set at a selected level along standard 11.

Figure 3:
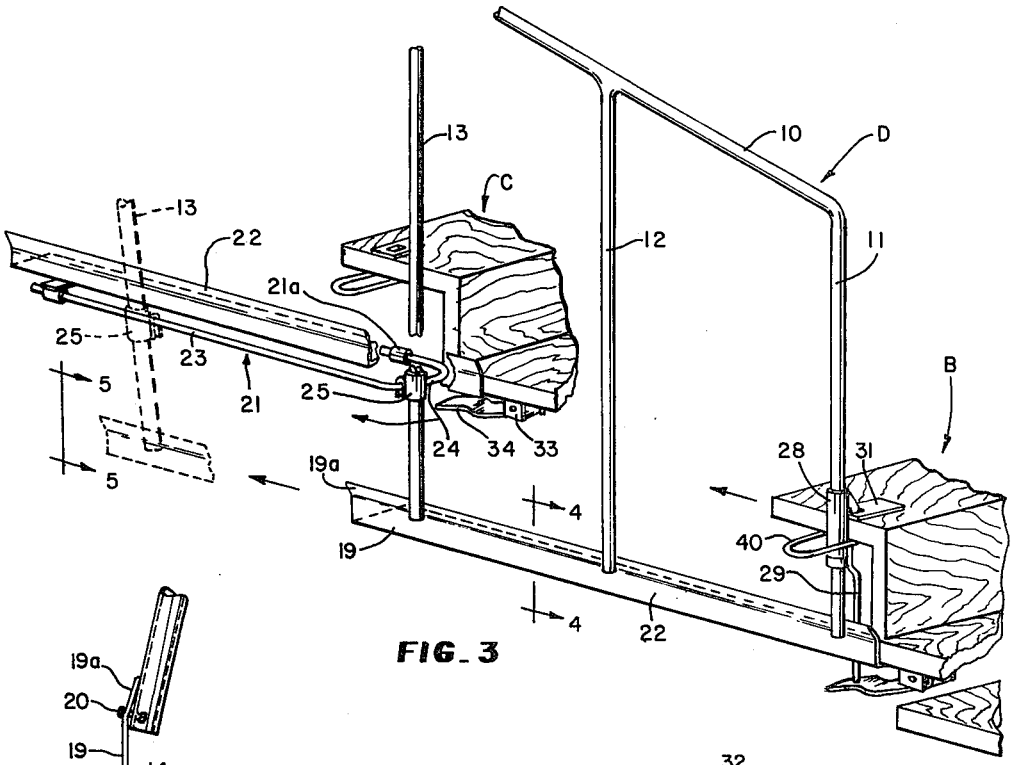
FIG. 3 is a broken perspective view illustrating the means for locking the guard rail units in upright position and for preparing the guard rail units for storage while the seating sections are being moved to compacted position.
Figure 6:
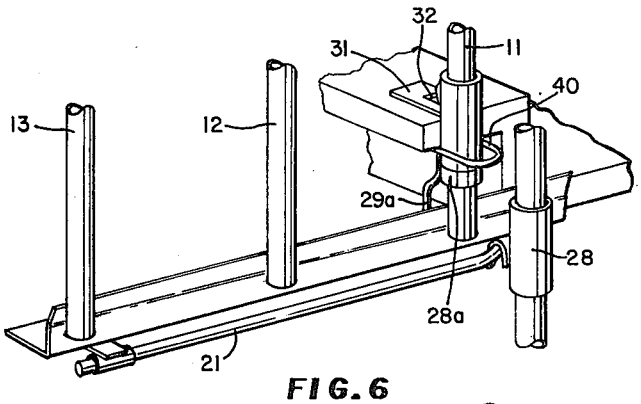
FIG. 6 is an enlarged detailed perspective view of the means shown in FIG. 3.
Figure 8:
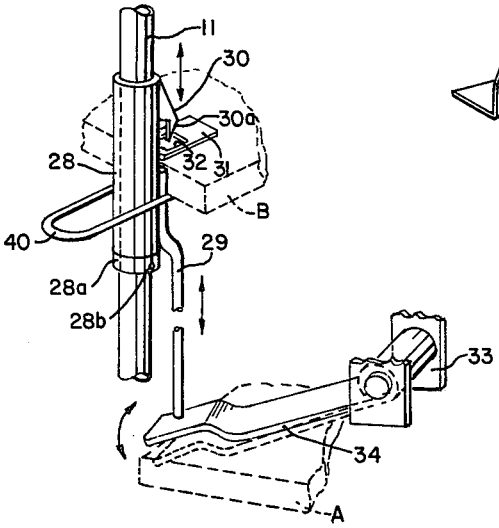
FIG. 8 is a schematic perspective view of the locking mechanism.

The locking mechanism for maintaining the guard rail in upright position while the seating sections are extended, is best shown in FIGS. 3, 6, and 8. The standard 11 has the collar 28 about it and the pin 29 has its upper end welded or otherwise secured to collar 28 so that the pin rises and decends with collar 28. Collar 28 also has secured thereto a detent 30 having a slanted face 30*a*. A plate 31 secured to seating section B contains an opening 32 into which a portion of detent 30 may fall to lock the guard rail unit with seating section B.

A U-shaped bracket 40, attached to the seat section B, serves to position the collar 28 and hold detent 30 in a position of alignment with opening 32 when the seating section B is fully extended while still allowing the tilting movement of the standard 11 as above described.

When the seating section B is being extended into position for use as bleachers, the guard rail units D will be moved toward its upright or vertical position which will bring the inclined face 30*a* of the detent 30 against the plate 31 so as to raise the collar 28 sufficiently to allow the detent 30 to pass over the plate 31 and fall into the opening 32 to lock the guard rail unit in its upright position.

For unlocking the locking mechanism just described I provide bracket 33 secured to the seat section B and a lever 34 pivotally attached to bracket 33. When the seating sections are to be compacted, seating section A is the first to be moved rearwardly, and when this is done a portion of seating section A contacts lever 34 pushing it upwardly to raise pin 29, which, in turn, raises collar 28 and raises detent 30 from opening 32, thus unlocking the guard rail unit B to permit its movement of the guard rail unit into slanted position for storage.

It may be further observed that the rearward movement of one seating section to compact the seating sections acts also to unlock the guard rail unit which is attached to the next higher, or the next to the rear, of the seating section being moved rearwardly. This makes it possible, when one seating section has been moved into compacted position, to then move the next seating section to the rear into compacted condition.

As shown more clearly in FIG. 1 the guard rail unit D has its front standard 11 located at a forward position in front of the rear edge of seat 15 of seating section B and has its rear standard 13 back of the forward edge of seat 17 of seating section C. This location bridges and guards the possibility of anyone occupying the structure accidentally walking off the side of the bleachers. Further, the rail members 20 of the guard rail units are slanted downwardly toward the front so that when these units are in their upright position the members 10 are aligned so that persons entering leaving the bleachers may follow these members 10 with their hands.

Also, we may observe that, as shown in FIG. 1, the rear standard 13 of guard rail unit D and the front standard 11 of guard rail unit E are each attached to the same seating section C and structure of this nature occurs wherever there are two adjacent guard rail units.

OPERATION

Let us start with the condition in which these seating sections and guard rail units are in their compacted position and stored against a back wall in which they occupy a minimum of space and are in the relationship illustrated in FIG. 2.

The seating section which is farthest to the rear may suitably have been secured to the back wall of the gymnasium or auditorium in which the bleachers are utilized, and the seating sections are moved forward and separated one by one beginning with the lowest seating section and ending with the seating section C at the highest level.

Next, the seating section A begins to advance forwardly into the position shown in FIG. 1. Note that no guard rail movement or locking mechanism is involved in this event.

When seating section B is reached and this section begins to come forward, the collar 25, being engaged and guided by the rod 21, slides forward along the straight portion 23 of the rod 21. When the collar 25 reaches the curved portion 24 of the rod, the collar 25, still following the rod, is moved inwardly, which causes standard 13 and the guard rail unit D to move inwardly about its attachment to seating section B, into erect or upright position. The detent 30, on collar 28, will have struck plate 31 and passed over the plate 31 to drop into the opening 32 to lock the guard rail unit D in vertical position.

When the bleachers have been used, and it is again desired to store the seating sections and guard rail units, seating section A may be moved rearwardly. When any part of seating section A contacts and moves lever 34 rearwardly and upwardly (see FIG. 8) so as to lift pin 29, this lifts collar 28 and detent 30 above plate 31 to unlock the guard rail unit D. Then rearward movement of seating section B operates by reason of collar 25 and rod 21 to turn the guard rail unit D to tilted position, and, near the end of this movement, to unlock the guard rail unit E, and so forth until all seating sections are compacted into the seating section at the back wall. This completes the cycle and when the structure is again desired to be used the cycle may be repeated.

We observe that the guard rail units remain unlocked until a seating section has been fully extended from the next above seating section, and that they remain locked and secure as to each seating section until the next below seating section has been compacted.

While only one embodiment of the improved seating and guard rail structure has been illustrated and described in detail, it is apparent that many other embodiments may be constructed, and many changes may be made all within the spirit of the invention and the scope of the following claims.

I claim:

1. A seating and guard rail structure comprising a first seating section and a second seating section, said first seating section being movable rearwardly into said second seating section to compact said structure for storage, a guard rail unit attached to said first seating section, and means automatically operable to move said guard rail unit outwardly to one side of said first seating section to a position in which said guard rail unit is slanted outwardly toward the upper portion of the unit when said first seating section is moved into said second seating section.

2. A seating and guard rail structure as set forth in claim 1 in which said means is also automatically operable to move said guard rail unit inwardly of said first seating section to a position in which said unit is upright when said first seating section is moved away from said second seating section to expand said structure.

3. A seating and guard rail structure as set forth in claim 1 or 2 in which said means includes a sliding adjusted rod secured to said second seating section.

4. A seating and guard rail structure as set forth in claim 3 which includes means for moving said rod which is attached to said second seating section forwardly or rearwardly with respect to said second seating section.

5. A seating and guard rail structure as set forth in claim 1 in which said guard rail unit is pivotally attached to first seating section and in which said means is effective for moving said unit about its pivot to an upright position.

6. A seating and guard rail structure as set forth in claim 5 in which said unit has a standard and including a collar about said standard and slidable along said standard.

7. A seating and guard rail structure as set forth in claim 6 including a third seating section which is movable into said first seating section to compact the structure and means automatically operable when said third seating section is moved into said first seating section for unlocking said guard rail unit against movement from its upright position.

8. A seating and guard rail structure as set forth in claim 5 including a rod secured to said second seating section, said collar being engaged with said rod and adapted to slide therealong, said rod being curved inwardly toward the front of the structure whereby movement of said collar forwardly and inwardly along said rod produces movement of said standard unit about its pivot toward an upright position.

9. A seating and guard rail structure as set forth in claim 1 in which each of said first and second seating sections have seats on which person may sit and in which said guard rail unit extends from a point in front of the rear edge of the seat on said first seating section to a point rearward of the front edge of said second seating section, whereby said guard rail unit is effective in guarding a portion of each of said seats and also the area between said seats.

* * * * *